US007044510B2

(12) United States Patent
Lin

(10) Patent No.: US 7,044,510 B2
(45) Date of Patent: May 16, 2006

(54) FIRE DOOR LOCK MECHANISM

(76) Inventor: Ching-Tien Lin, No. 2, Lane 112 Chu-Yuan Road Hsin-Chung, Taipei, Hsien (TW)

( * ) Notice: Subject to any disclaimer, the term of this patent is extended or adjusted under 35 U.S.C. 154(b) by 112 days.

(21) Appl. No.: 10/615,012

(22) Filed: Jul. 9, 2003

(65) Prior Publication Data

US 2004/0124639 A1 Jul. 1, 2004

(30) Foreign Application Priority Data

Dec. 27, 2002 (TW) ..... 91221282 U

(51) Int. Cl.
*E05B 65/10* (2006.01)

(52) U.S. Cl. ..... 292/93; 292/DIG. 65

(58) Field of Classification Search ..... 292/92, 292/93, 336.3, DIG. 65
See application file for complete search history.

(56) References Cited

U.S. PATENT DOCUMENTS 4,796,931 A * 1/1989 Heid ..... 292/92
4,961,330 A * 10/1990 Evans ..... 70/21
5,169,185 A * 12/1992 Slaybaugh et al. ..... 292/92
5,322,332 A * 6/1994 Toledo et al. ..... 292/92
5,490,697 A * 2/1996 Surko, Jr. ..... 292/92
5,947,534 A * 9/1999 Zarzycki, Jr. ..... 292/92
5,988,708 A * 11/1999 Frolov et al. ..... 292/92
6,189,939 B1 * 2/2001 Zehrung ..... 292/92

* cited by examiner

*Primary Examiner*—Gary Estremsky
(74) *Attorney, Agent, or Firm*—Shoemaker and Mattare

(57) ABSTRACT

A fire door lock mechanism is provided, allowing a user to directly push and press a handlebar forwards to activate a lock bolt and open a fire door mounted with the lock mechanism in a comfortable manner. A first opening unit of the lock mechanism is located inside the fire door to operate the lock bolt. The handlebar is located in a second opening unit of the lock mechanism on the fire door. The handlebar, being pressed, activates a link arm connected thereto and accordingly induces a swing arm coupled to the link arm to generate a swing motion, so as to allow a pulley formed at one end of the swing arm to extend into the first opening unit and drive a lock bolt mount connected to the lock bolt to move horizontally, thereby making the lock bolt retract to release the lock mechanism.

8 Claims, 9 Drawing Sheets

FIRE DOOR LOCK MECHANISM

FIELD OF THE INVENTION

The present invention relates to fire door lock mechanisms, and more particularly, to a fire door lock mechanism which allows a user to easily push forwards to open a fire door mounted with the fire door lock mechanism.

BACKGROUND OF THE INVENTION

A conventional fire door, as shown in FIG. 1, is opened by pressing a handlebar 11 of a handlebar mount 10 horizontally located in the middle of the fire door, whereby a lock bolt 12*d* in a lock body 12 is retracted and relieves a locked state that closes and locks the fire door, thereby making the fire door opened. This operation is achieved by a diagonal depression motion of the handlebar 11 which is pressed by a user to move in a downward and diagonal direction. Please refer to FIGS. 2 and 3 which shown the structure of a conventional fire door lock being rotated by 90 degrees to be oriented in a horizontal direction for clear illustration. The handlebar mount 10 houses a handlebar 11 that allows a user to press downwards and a lock body 12 that accommodates a lock bolt 12*d*. The handlebar 11 is screwed to two horseshoes 13 located at the bottom of the handlebar mount 10. A roller 13*b* penetrates through two slanted slots 13*a* respectively formed on two side walls of each horseshoe 13 and is fixed to the side walls of the horseshoe 13 by means of a pin 13*c*. A pin 13*e* having a wound elastic member 13*d* thereon is secured to the bottom of each horseshoe 13, wherein one end of the elastic member 13*d* is in contact with the bottom of the roller 13*b* on which an upward compression force is exerted. Under a normal condition, the pin 13*c* of the roller 13*b* holds the handlebar 11 in position at the top of the handlebar mount 10. When the user exerts a force on the handlebar 11, the roller 13*b* is pushed downwards and travels along the slots 13*a* of each horseshoe 13 by the force, thereby inducing diagonal translocation of the handlebar 11 in the handlebar mount 10. The lock body 12 located at the front of the handlebar mount 10, shown in FIG. 3, comprises a seesaw lever 12*a* which is constructed by coupling a push part 12*b* and a pull part 12*c*, wherein the push part 12*b* is in contact with an inside surface of the handlebar 11 and the pull part 12*c* is engaged with a cavity 12*e* formed by the lock bolt 12*d* in the lock body 12. When the user presses the handlebar 11, the push part 12*b* of the lever 12*a* is pushed downwards while the pull part 12*c* is moved upwards. At the same time, the pull part 12*c* comes into contact with the lock bolt 12*d* which is driven to rotate in a counterclockwise direction, making the lock bolt 12*d* retracted into the lock body 12 to facilitate a door opening action.

In view of the above door opening operation in the use of the conventional fire door lock, although the user presses the handlebar 11 in a manner as illustrated by the arrow in FIG. 3, the handlebar 11 is moved in a diagonal direction by the roller 13*b* travelling along the slots 13*a* of each horseshoe 13 in the handlebar mount 10. The diagonal movement of the handlebar 11 is composed of a vertical movement and a horizontal movement. And the force exerted by the user is undesirably divided into two components: a force vertical to the push part 12*b* and used for operating the lock bolt 12*d*, and a force horizontal to the push part 12*b* and having no contribution to the lock bolt 12*d*, which therefore requires a larger amount of force exerted by the user due to wastage. Further, the horizontal movement of the handlebar 11 makes the travel direction of the handlebar 11 different from that of the hands of the user, which causes discomfort to the hands of the user when operating the door lock.

Furthermore, when the lock bolt 12*d* of the conventional fire door lock is extended from the lock body 12, as shown in FIG. 1, the lock bolt 12*d* is inserted into a catch 14 which has an opening for accommodating the lock bolt 12*d* and which is adhered to a surface of a door frame of the fire door. However, the catch 14 protrudes outwardly from the surface of the door frame and thus distorts the overall appearance. Moreover, the exposed catch 14 is easily subject to damage from vandals. Therefore, a novel fire door lock which can eliminate the above drawbacks is greatly desired.

SUMMARY OF THE INVENTION

An objective of the present invention is to provide a fire door lock mechanism which allows users to press a handlebar in a vertical direction with respect to a first door mounted with the fire door lock mechanism to activate a lock bolt in a comfortable manner to open the first door.

Another objective of the invention is to provide a fire door lock mechanism which allows the lock bolt extended from a lock body to be directly inserted into a hole formed on an inner side of a door frame, such that when the door lock mechanism is engaged, the lock bolt cannot be easily damaged by vandals, thereby increasing the security of the door lock mechanism.

In order to achieve the above and other objectives, the present invention provides a fire door lock mechanism which allows a first opening unit thereof to be located inside a fire door mounted with the lock mechanism and to activate a lock bolt of the lock mechanism to move. Moreover, a second opening unit laterally located on the fire door has a handlebar coupled with an actuator for operating the lock bolt. When the handlebar is pushed and pressed by a user, the actuator activates a push rod and a link arm to move horizontally. One end of the link arm is coupled to a swing arm which is thus induced by the link arm to generate a swing motion, wherein one end of the swing arm has a pulley extending into the first opening unit to activate a lock bolt mounted connected to the lock bolt to move horizontally. As a result, the lock bolt is accordingly adapted to extend from or retract into the first opening unit in a horizontal direction to facilitate the release or engagement of the lock mechanism.

Furthermore, the first opening unit of the fire door lock mechanism comprises a rotation member having at least one disk coupled to a rotational handle, so as to allow the disk to be driven by the rotational handle to activate a rotatable plate having an arm that is coupled to the lock bolt mount. When the rotatable plate rotates, the arm exerts a force on the lock bolt mount and induces the lock bolt mount to move horizontally, such that the lock bolt connected to the lock bolt mount can extend from and retract into first opening unit to engage or disengage the lock mechanism, thereby making the user to operate the handlebar and open the fire door in a comfortable manner.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
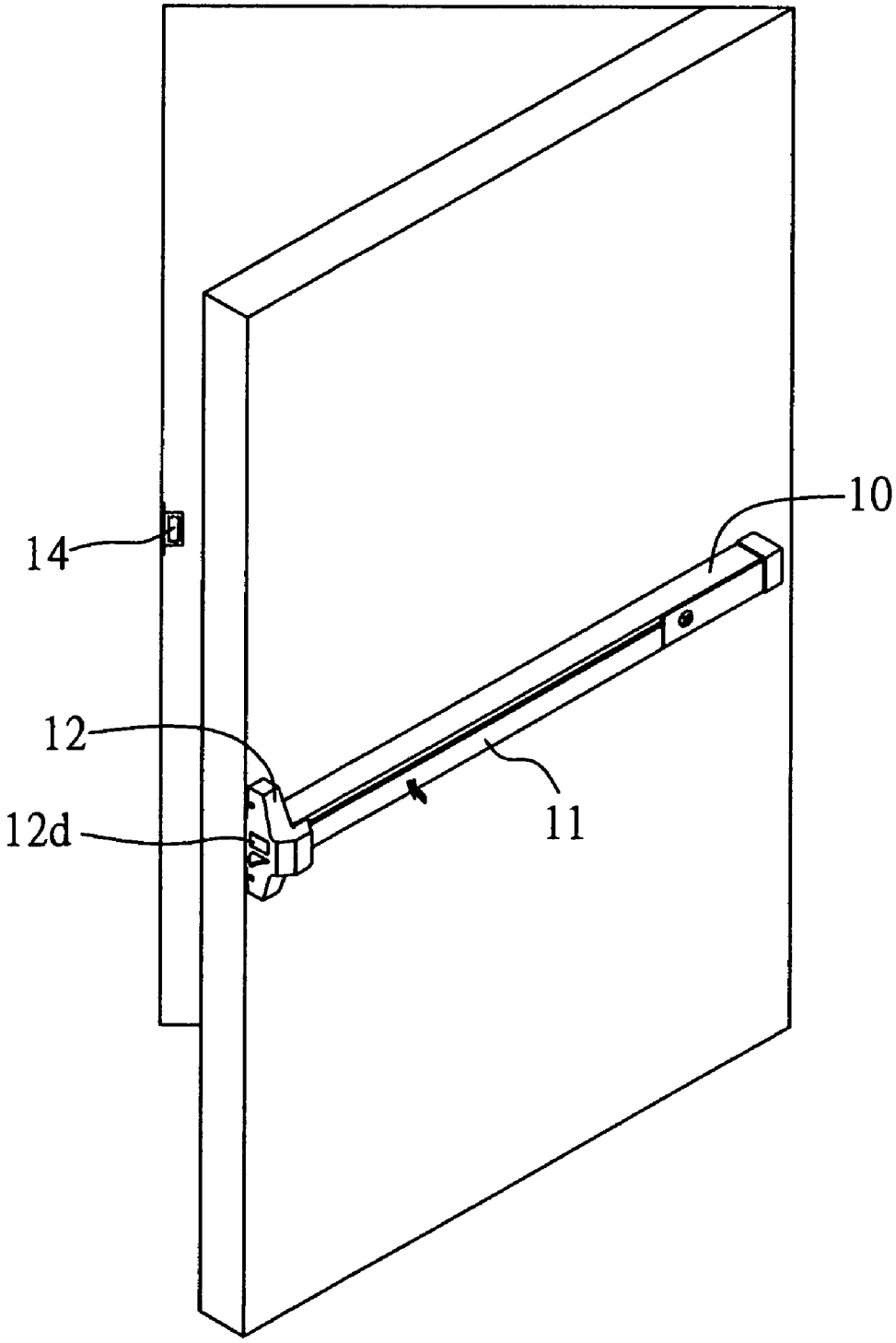
FIG. 1 (PRIOR ART)
FIG. 1 (PRIOR ART) is a schematic diagram of a fire door mounted with a conventional fire door lock.
Figure 2:
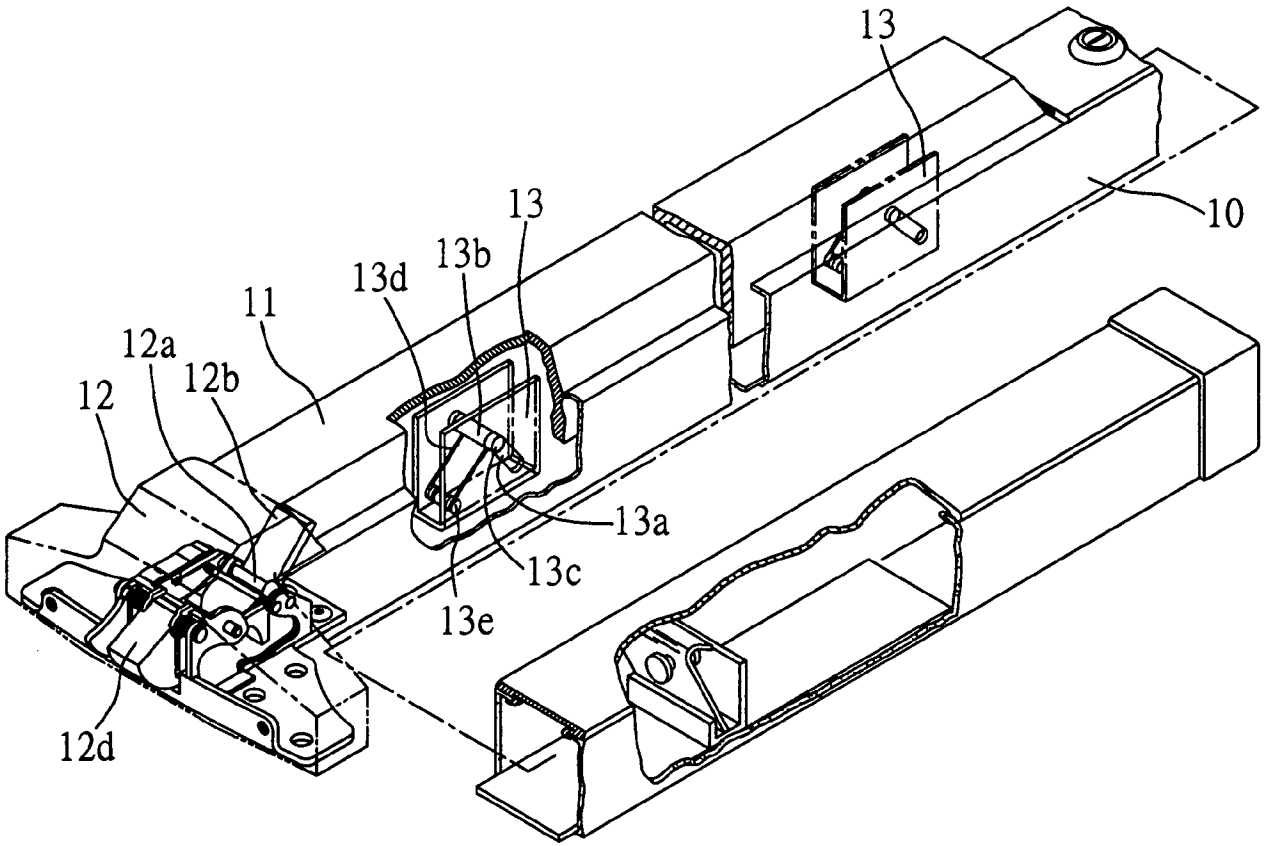
FIG. 2 (PRIOR ART)
FIG. 2 (PRIOR ART) is a schematic diagram showing the structure of the conventional fire door lock.
Figure 3:
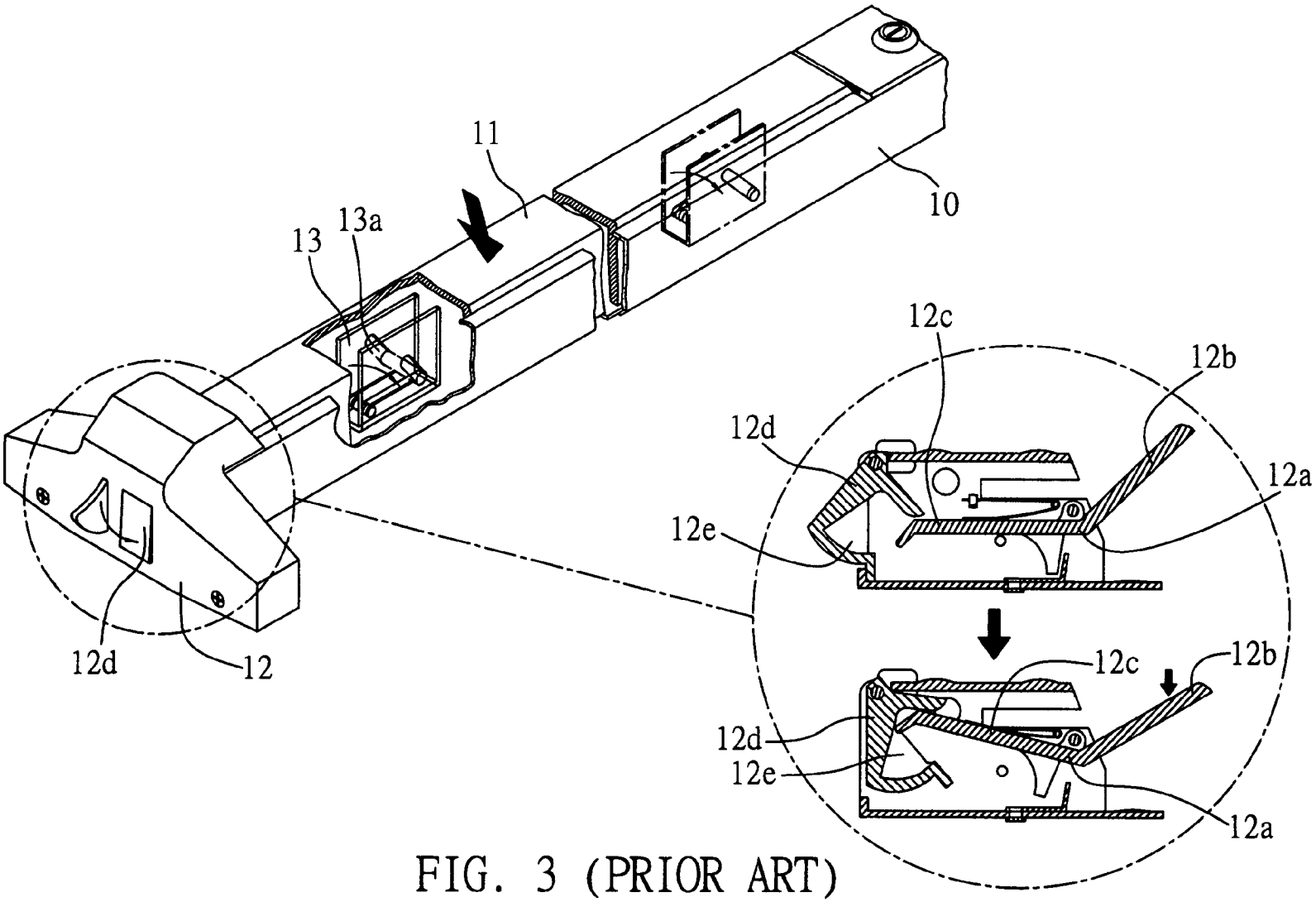
FIG. 3 (PRIOR ART)
FIG. 3 (PRIOR ART) is a schematic diagram showing the mechanics of the conventional fire door lock.
Figure 4:
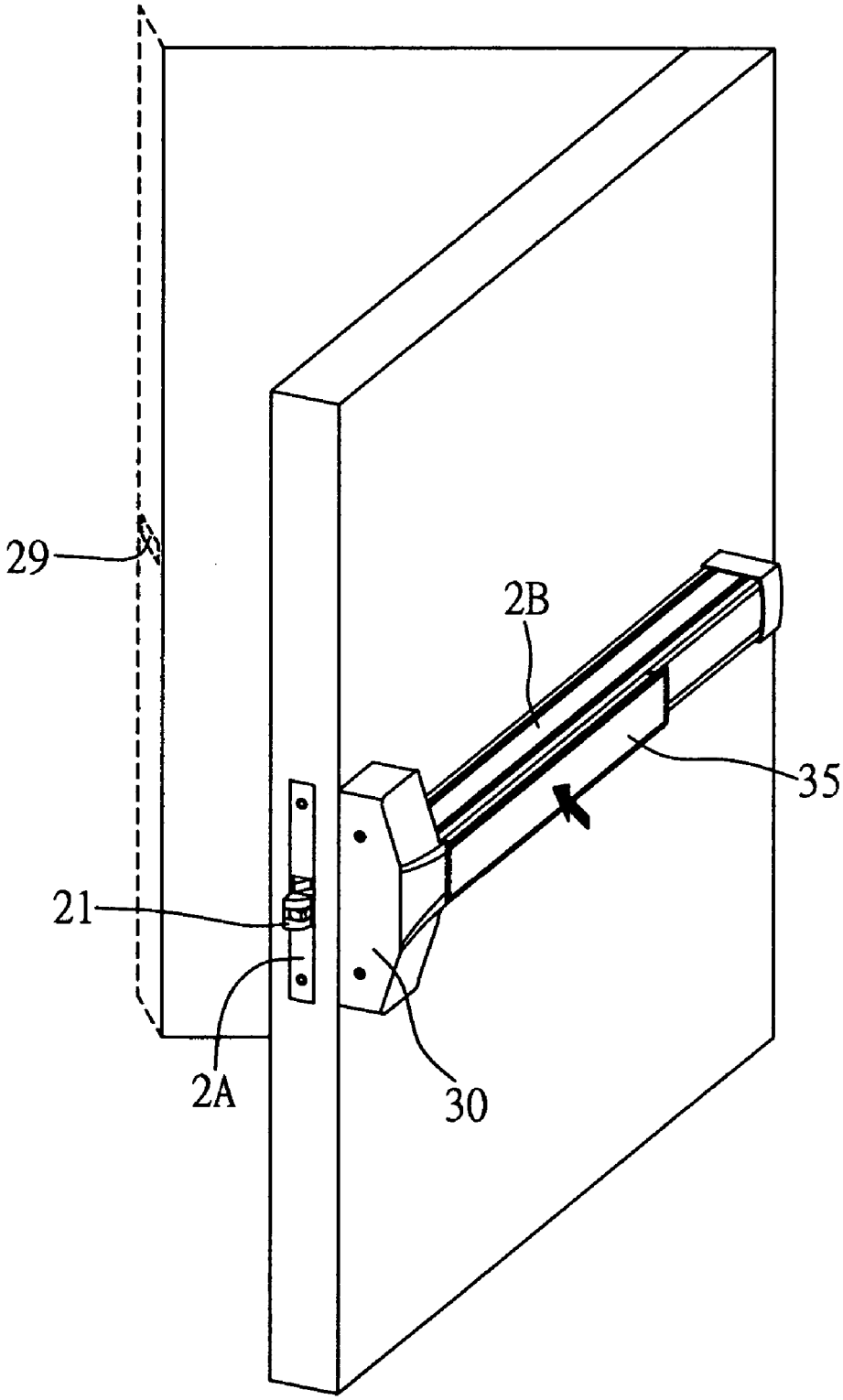
FIG. 4 is a schematic diagram of a fire door mounted with a fire door lock mechanism according to a preferred embodiment of the invention.

FIG. 4 is a schematic outlook of a fire door mounted with a fire door lock mechanism according to a preferred embodiment of the invention. This lock mechanism comprises a first opening unit 2A and a second opening unit 2B having a handlebar 35. The first opening unit 2A is disposed between door panels inside the fire door for activating a lock bolt 21 to extend from and retract into the first opening unit 2A in a horizontal direction so as to engage or disengage the lock mechanism.

Figure 5:
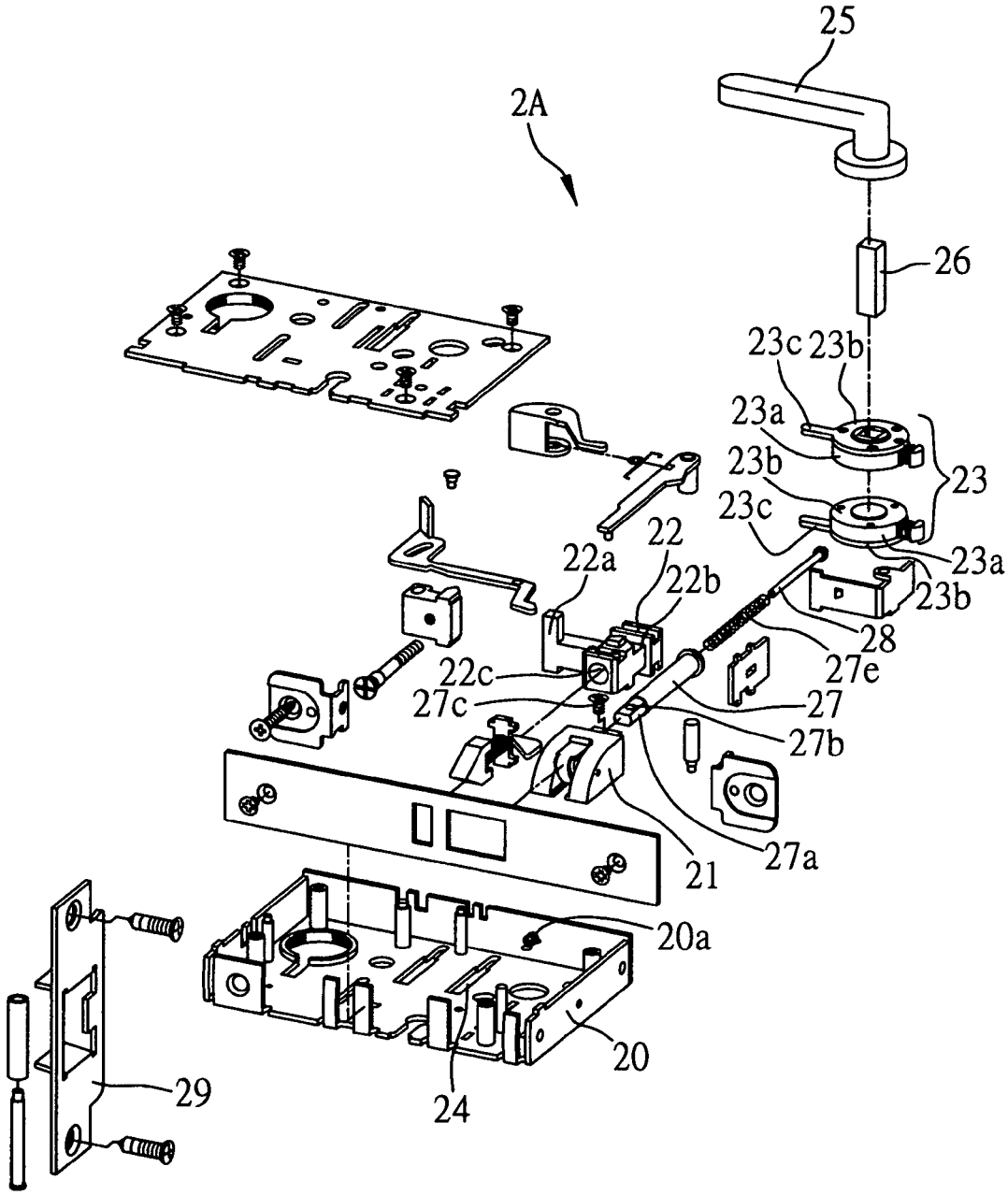
FIG. 5 is an exploded diagram of a first opening unit of the fire door lock mechanism according to the invention.
Figure 6:
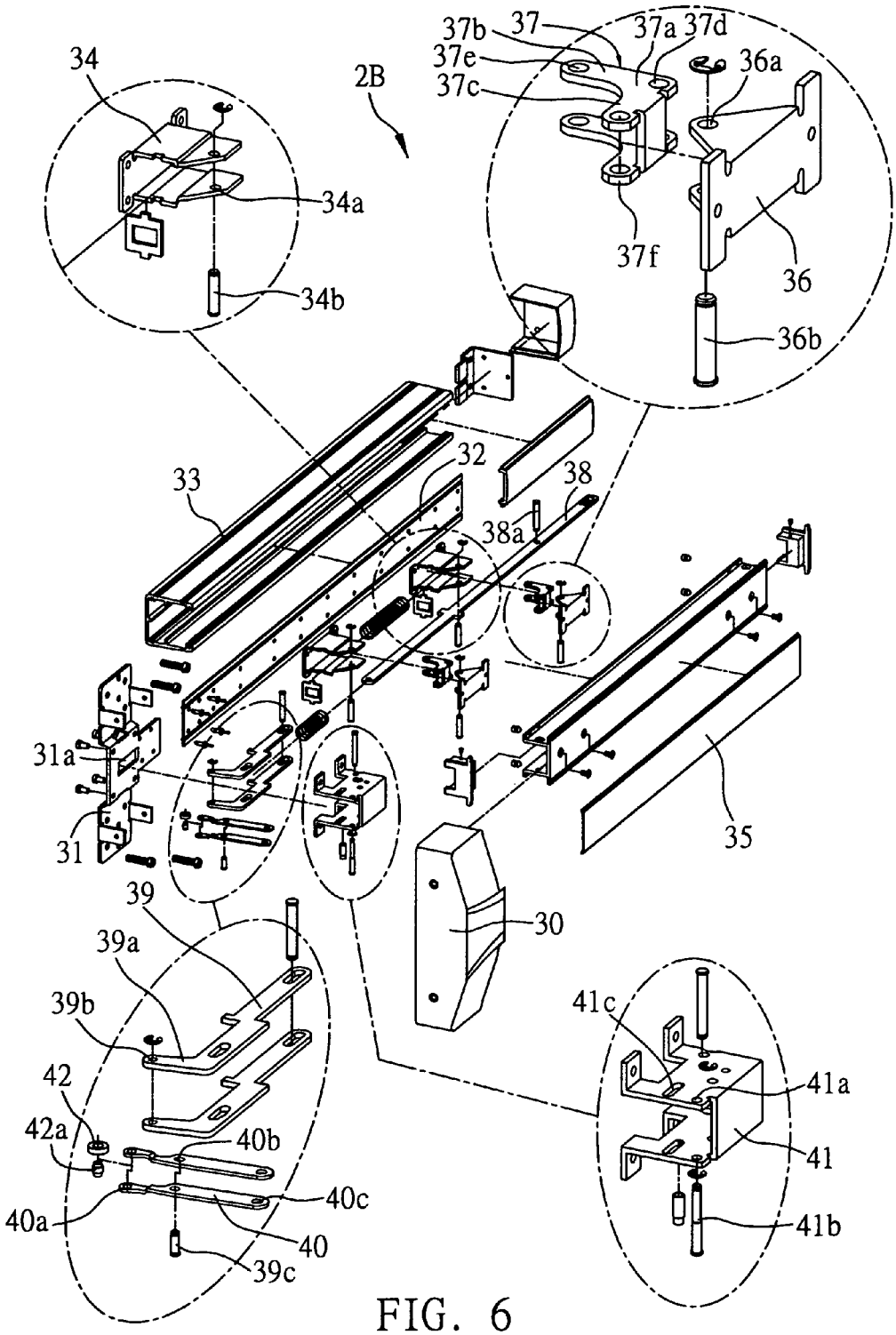
FIG. 6 is an exploded diagram of a second opening unit of the fire door lock mechanism according to the invention.

Please refer to FIGS. 5 and 6 which respectively illustrate the first opening unit 2A and the second opening unit 2B. The first opening unit 2A comprises: a lock body 20 for accommodating the components of the lock bolt 21, and a rotation member 23 connected to an external rotational handle 25, the rotation member 23 having an upper disk 23*a* and a lower disk 23*a* each of which is coupled to a rotatable plate 23*b*, so as to allow an arm 23*c* formed on the rotatable plate 23*b* to induce a horizontal movement of lock bolt mount 22. A slot 24 is located at the bottom of the lock body 20 and horizontally corresponds to a protrusion 22*a* formed on a side of the lock bolt mount 22. One end of the lock bolt mount 22 is coupled to the lock bolt 21. As a result, the lock bolt 21 can freely extend from and retract into the lock body 20 along with the horizontal movement, Referring to FIG. 6, the second opening unit 2B comprises: a lock cover 30 for covering the components of the lock bolt 21, wherein the bottom of the lock cover 30 is coupled to a lock cover mount plate 31 and one end thereof is coupled to a base plate 32 engaged with a recessed base mount 33; a first horseshoe 34 provided at each of two ends of the base plate 32 and having a substantially triangular shape with a hole 34*a* located on a top side thereof; a handlebar 35 received in the base mount 33 and capable of being pressed by a user to move to disengage the lock mechanism; a second horseshoe 36 located at each of two bottom ends of the handlebar 35 and having a substantially triangular shape with a hole 36*a* located on bottom side thereof; an actuator 37 bent by a right angle to form a central portion 37*a* having a hole 37*d*, a left end portion 37*b* having a hole 37*e*, and a right end portion 37*c* having a hole 37*f*; a push rod 38 of an elongated shape having each end thereof being inserted with a pin 38*a* which is coupled to the hole 37*e* of the left end portion 37*b* of the actuator 37; a link arm 39 coupled to an end of the push rod 38 and induced by the push rod 38 to generate a horizontal force; a swing arm 40 coupled to an end of the link arm 39 and induced by the link arm 39 to generate a swinging motion, so as to allow the swing arm 40 to extend through the slot 24 of the first opening unit 2A (FIG. 5) to induce the horizontal movement of the lock bolt mount 22; and a lock cover mount 41 for receiving the link arm 39 and the swing arm 40, the swing arm 40 being secured to the lock cover mount 41 by a pin 41 *b* to allow the swing motion thereof. By the coordination of the aforementioned components, the user can easily press the handlebar 35 forward in an energy-saving and comfortable manner to release the lock mechanism.

The second horseshoes 36 coupled to the handlebar 35 each is formed with a hole 36*a* at the bottom thereof for accommodating a pin 36*b* inserted into the hole 37*f* of the right end portion 37*c* of the actuator 37, thereby allowing the actuator 37 to use the pin 36*b* as a pivot to rotate. Furthermore, the actuator 37 is formed with a recess portion by which the actuator 37 can be bridged on the push rod 38. A pin 34*b* is inserted into the hole 37*d* of the central portion 37*a* of the actuator 37 and the hole 34*a* of the first horseshoe 34 to connected the actuator 37 and the first horseshoe 34. When the second horseshoe 36 receives a force from the handlebar 35 pressed by the user and moves, the left end portion 37*b* of the actuator 37 is accordingly adapted to move at the same time, making the right end portion 37*c* of the actuator 37 to swing about the pin 34*b* as a pivot in the hole 34*a* of the first horseshoe 34, to thereby induce a horizontal movement of the push rod 38 and the link arm 39 coupled to the push rod 38.

A front end of the link arm 39 is formed with a bent portion 39*a* bent by a right angle whose bottom has a hole 39*b* for accommodating a pin 39*c* which is coupled to a hole 40*b* located at a central position of the swing arm 40 to thereby connect the link arm 39 and the swing arm 40. The pin 39*c* is further coupled to an elliptic slot 41*c* of the lock cover mount 41, whereby the horizontal displacement of the pin 39*c* in the slot 41*c* can increase the swinging amplitude of the swing arm 40. The swing arm 40 is further provided with a hole 40*c* for receiving a pin 41 coupled to a holes 41 of the lock cover mount 41; as such, the swing arm 40 can be adapted to generate the swing motion by the link arm 39 with the pin 41*a* serving as a pivot. Further, a hole 40*a* is located at the bottom of the swing arm 40 for receiving a pin 42*a* which connects a pulley 42 to the bottom of the swing arm 40. The pulley 42 can extend from a slot 31*a* at a central position of the lock cover mount plate 31 or retract into the slot 24 at the bottom of the lock body 20. The pulley 42 is in contact with the protrusion 22*a* of the lock bolt mount 22 and extended out of the lock body 20 by the swing motion of the swing arm 40 to allow the lock mechanism in an engage state.

As shown in FIG. 5, the lock body 20 receives the rotation member 23 coupled to the rotational handle 25 operatable by the user. The rotational handle 25 is disposed on a side of the fire door that faces the outside and coupled to the rotation member 23 by a square-shaped column 26. The rotation member 23 has the upper and lower disks 23*a*, 23*a* respectively connected to the upper and lower rotatable plates 23*b*, 23*b*. Each of the rotatable plates 23*b* has an arm 23*c* engaged with a recess portion 22*b* of the lock bolt mount 22. When the disks 23*a* are driven by the rotational handle 25 to rotate, the arms 23*c* rotate to induce the lock bolt mount 22 to move horizontally.

Figure 7:
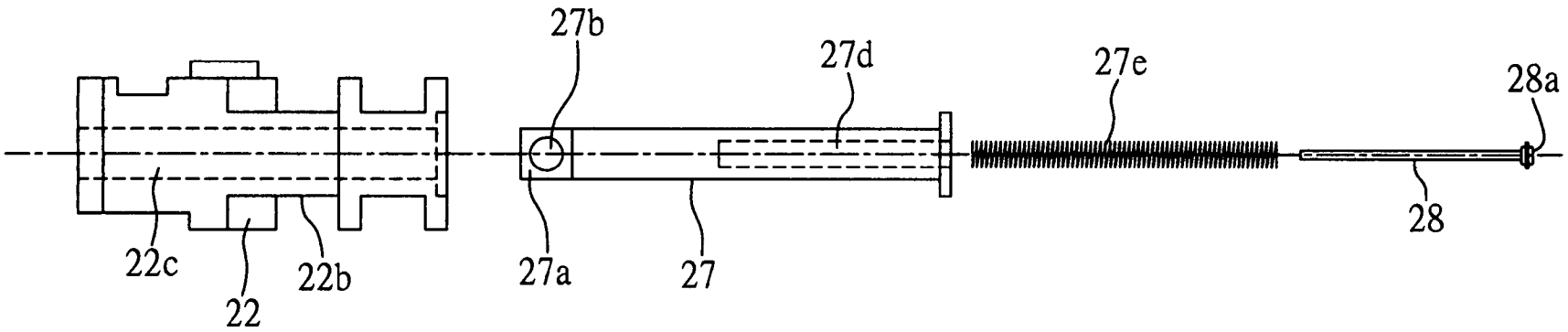
FIG. 7 is a schematic diagram showing part of components of the fire door lock mechanism according to the invention.

A through hole 22*c* is formed at a central position of the lock bolt mount 22 and accommodates a flat front close end 27*a* of a shaft 27. A hole 27*b* is formed at the flat front end 27*a* of the shaft 27 for receiving a screw 27*c* connected to the lock bolt 21. As shown in FIG. 7, a hole 27*d* is formed at the other open end of the shaft 27 and has a predetermined depth which allows a rod 28 sleeved with an elastic member 27*e* thereon to be inserted into the hole 27*d*. The rod 28 has one end formed with a flange 28*a* that has a larger diameter than the elastic member 27*e* for securing the elastic member 27*e* in position. The elastic member 27*e* has a length greater than that of the rod 28 and the depth of the hole 27*d* of the shaft 27, such that by provision of the flange 28*a* of the rod 28, the elastic member 27*e* is held in a compressed status inside the hole 27*d* of the shaft 27.

Furthermore, the flange 28*a* of the rod 28 is inserted into a hole 20*a* on a side wall of the lock body 20: as such, one end of the rod 28 is secured to the lock body 20, making the elastic member 27*e* at the other end of the rod 28 press the shaft 27 to move towards a lock bolt catch 29 (as shown in FIGS. 4 and 5) and thereby inducing the lock bolt 21 to protrude from the lock body 20. When the recess portion 22*b* of the lock bolt mount 22 is moved by the arms 23*c* of the rotatable plates 23*b* of the rotational handle 25, due to a force exerted from the arms 23*c* being greater than a force pressed on the shaft 27 by the elastic member 27*e*, the lock bolt mount 22 is pushed by the arms 23*c* towards a direction away from the lock bolt catch 29, making the lock bolt 21 retract into the lock body 20 to release or disengage the lock mechanism.

Figure 8A:
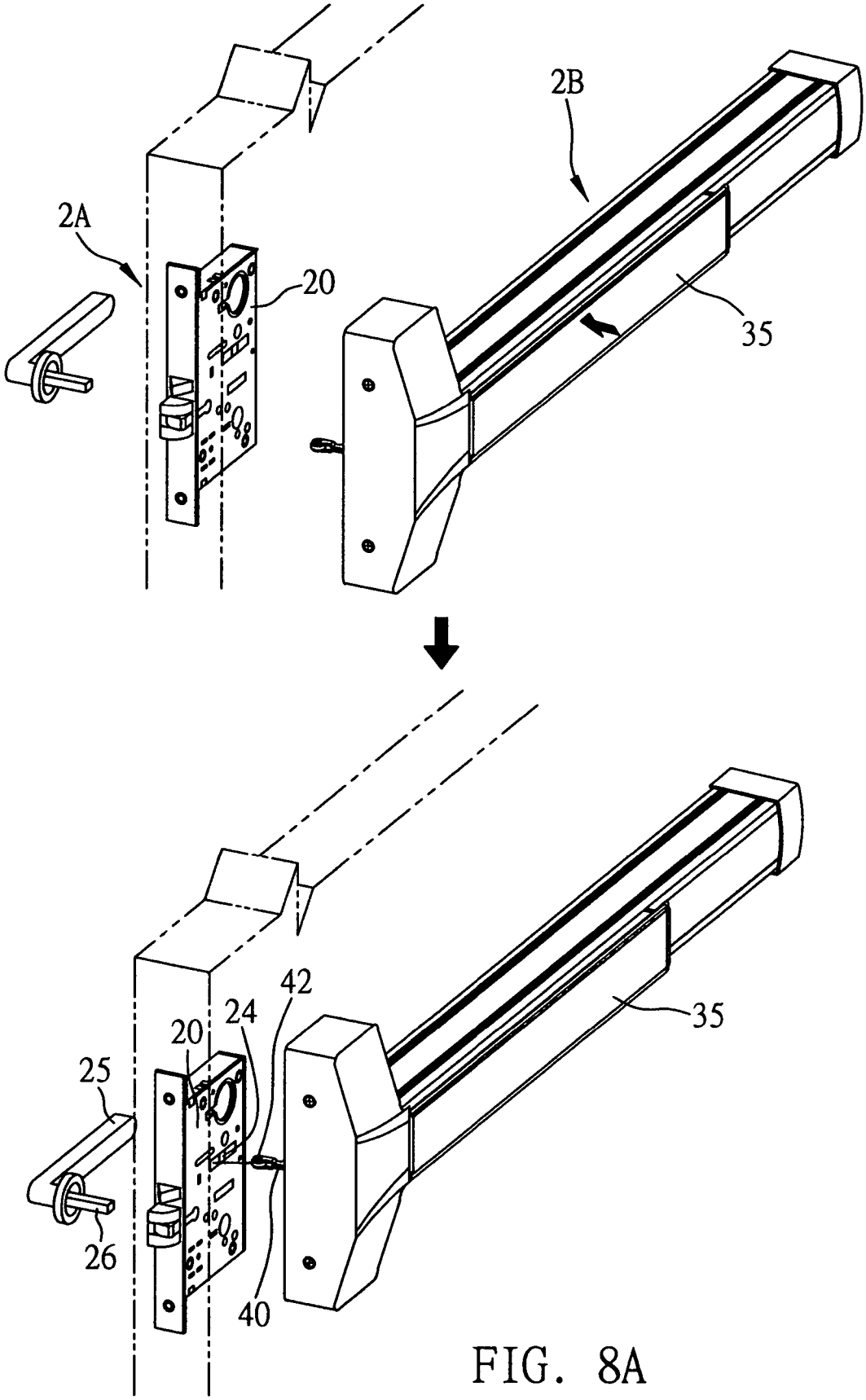
FIGS. 8A and 8B are perspective diagrams showing the structure of the fire door lock mechanism according to the invention.
Figure 8B:
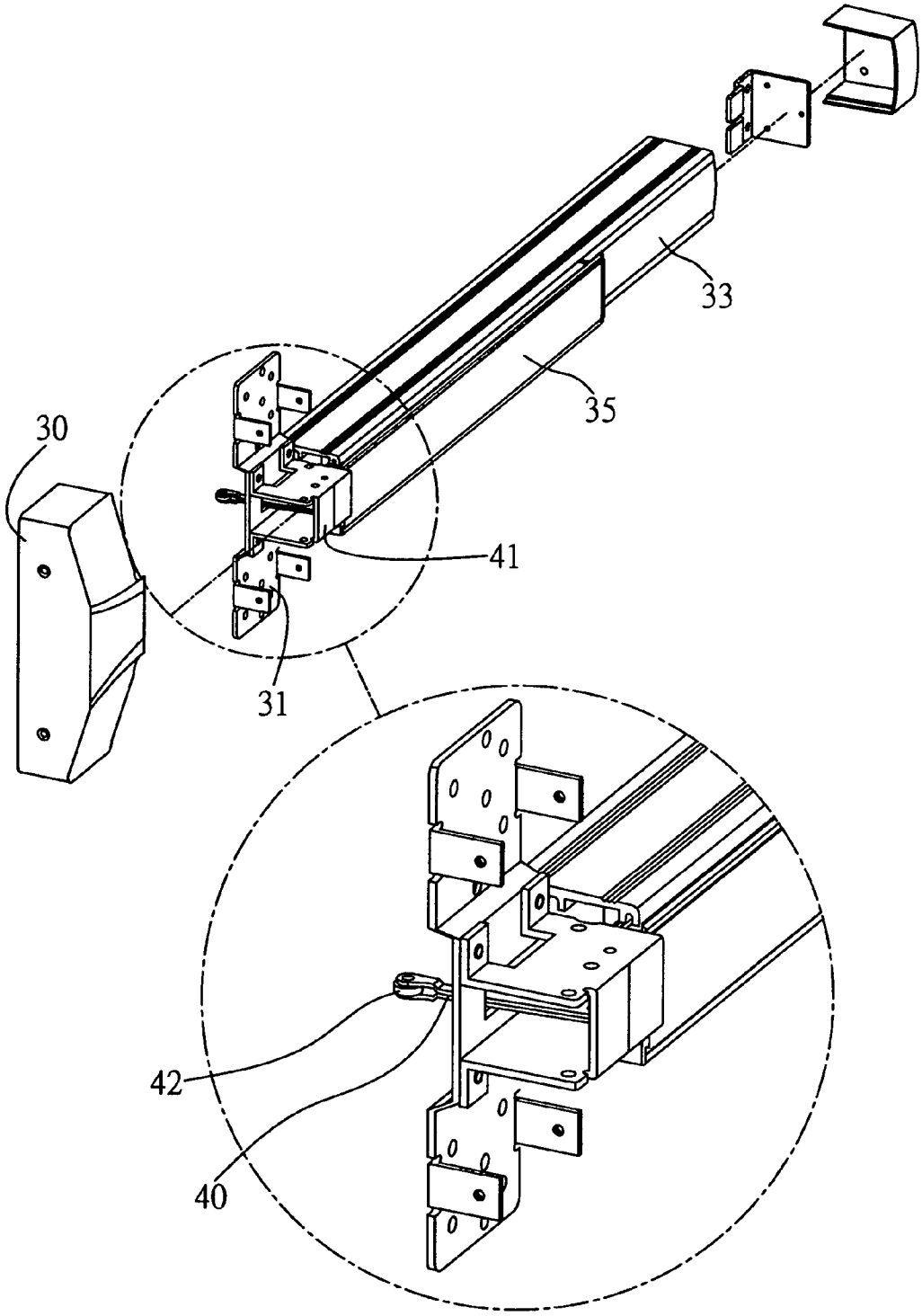

Moreover, the protrusion 22*a* is located on one side of the lock bolt mount 22, the slot 24 formed at the bottom of the lock body 20 horizontally corresponds to the protrusion 22*a* in position. As shown in FIGS. 8A and 8B, the swing arm 40 is inserted into the slot 24, and the pulley 42 at the bottom of the swing arm 40 is in contact with the protrusion 22*a* of the lock bolt mount 22. When the handlebar 35 is pressed by the user as shown in FIG. 4, the push rod 38 is pushed to generate the swing motion of the swing arm 40, and the pulley 42 of the swing arm 40 induces the lock bolt mount 22 to move horizontally, making the lock bolt 21 coupled to the lock bolt mount 22 move away from the lock bolt catch 29 and retract into the lock body 20 to disengage the lock mechanism.

Besides, the lock bolt mount 22 can be made of a heat melting material. When the fire door lock mechanism experiences a high temperature in a fire, the lock bolt mount 22 melts and the shaft 27 fails to be moved by the arms 23*c* of the rotatable plates 23*b* of the rotation member 23. In the meantime, pressing the rotational handle 25 or the handlebar 35 cannot push the shaft 27 to move towards a door frame of the fire door; on the other hand, the elastic member 27*e* inside the shaft 27 and on the push rod 28 can generate a compression force to move the shaft 27 towards the lock bolt catch 29, thereby making the lock bolt 21 connected to one end of the shaft 27 move towards the lock bolt catch 29 and extend from the lock body 20 to maintain the door mechanism in a locked state during the fire. As a result, the lock mechanism cannot be released or disengaged by operating the external rotational handle 25 or the handlebar 35, such that the fire door cannot accidentally opened during the fire and the flames can be prevented from spreading to unintended areas to damage people for the sake of the safety purpose.

The present invention has been described using exemplary preferred embodiments. However, it is to be understood that the scope of the invention is not limited to the disclosed embodiments. On the contrary, it is intended to cover various modifications and similar arrangements; for example, the connection means between the swing arm 40 and the lock bolt mount 22 can be replaced by a hook or a pin, or the elastic member 27*e* can be modified to externally wrap the shaft 27 or directly mounted inside the shaft 27. The scope of the claims, therefore should be accorded the broadest interpretation so as to encompass all such modifications and similar arrangements.

What is claimed is:

1. A fire door lock mechanism comprising a first opening unit located within a fire door and coupled to an opening member mounted on a surface of the fire door for operating a lock bolt of a lock bolt mount that is disposed within the first opening unit to allow the fire door lock mechanism to enter a released or engaged state; and a second opening unit mounted on an opposite surface of the fire door corresponding in position to the opening member, wherein the second opening unit comprises:

a base plate;

a handlebar capable of being pressed to move relative to the base plate;

two actuators rotatably disposed inside the handlebar and bent to form a central portion and two end portions, each of the portions being formed with a hole; two second horseshoes provided at two bottom ends of the handlebar respectively, each of the second horseshoes being formed with a hole at the bottom end thereof for accommodating a pin inserted into the hole of one end portion of a respective corresponding one of the actuators;

two first horseshoes provided at two ends of the base plate respectively, each of the first horseshoes being formed with a hole at the top end thereof for accommodating a pin inserted into the hole of the central portion of a respective corresponding one of the actuators;

a push rod, each end of the push rod being provided with a pin for coupling the hole of the other end portion of a respective corresponding one of the actuators; and a swing arm coupled to an end of the push rod and extended to the inside of the fire door, the swing arm being driven by a motion of the push rod coupled to the handlebar to operate the lock bolt and allow the fire door lock mechanism to enter the corresponding released or engaged state, wherein the actuators, the first horseshoes, the second horseshoes and the push rod are configured such that when the second horseshoes receive a force from the handlebar and move downwardly accordingly, the actuators swing about the first horseshoes as pivots, to thereby induce a horizontal movement of the push rod, wherein the opening member is a rotational handle coupled to a rotation member which is mounted inside the fire door and comprises an upper disk and a lower disk, the upper and lower disks being used to rotate an upper rotatable plate and a lower rotatable plate each being provided with an arm used to drive the lock bolt mount to move horizontally.

2. The mechanism of claim 1, wherein each actuator is bent at a right angle to form the central portion and the end portions.

3. The mechanism of claim 1, further comprising a link arm has one end coupled to an end of the push rod and the other end coupled to the swing arm, so as to receive the motion of the push rod and generate a horizontal force to induce the swing arm to generate a swing motion.

4. The mechanism of claim 3, wherein the link arm and the swing arm are accommodated in a lock cover mount, and the swing arm is connected to the lock cover mount by a pin to generate the swing motion.

5. A fire door lock mechanism comprising a first opening unit located inside a fire door and coupled to an opening member mounted on a surface of the fire door for operating a lock bolt of a lock bolt mount that is disposed within the first opening unit to allow the fire door lock mechanism to enter a released or engaged state; and a second opening unit mounted on an opposite surface of the fire door corresponding in position to the opening member, wherein the second opening unit comprises:

a base plate;

a handlebar capable of being pressed to move relative to the base plate;

two actuators rotatably disposed inside the handlebar and bent to form a central portion and two end portions, each of the portions being formed with a hole;

two second horseshoes provided at two bottom ends of the handlebar respectively, each of the second horseshoes being formed with a hole at the bottom end thereof for accommodating a pin inserted into the hole of one end portion of a respective corresponding one of the actuators;

two first horseshoes provided at two ends of the base plate respectively, each of the first horseshoes being formed with a hole at the top end thereof for accommodating a pin inserted into the hole of the central portion of a respective corresponding one of the actuators;

a push rod, each end of the push rod being provided with a pin for coupling the hole of the other end portion of a respective corresponding one of the actuators;

a swing arm coupled to an end of the push rod and extended to the inside of the fire door, the swing arm being driven by a motion of the push rod coupled to the handlebar to operate the lock bolt and allow the fire door lock mechanism to enter the corresponding released or engaged state; and a link arm having one end coupled to an end of the push rod and the other end coupled to the swing arm, wherein the actuators, the first horseshoes, the second horseshoes and the push rod are configured such that when the second horseshoes receive a force from the handlebar and move downwardly accordingly, the actuators swing about the first horseshoes as pivots, to thereby induce a horizontal movement of the push rod, and the link arm receives the motion of the push rod and generates a horizontal force to induce the swing arm to generate a swing motion, wherein the link arm and the swing arm are accommodated in a lock cover mount, and the swing arm is connected to the lock cover mount by a pin to generate the swing motion, wherein the end of the link arm, coupled to the swing arm, is formed with a bent portion bent at a right angle, and a hole is formed at the bottom of the bent portion and accommodated a pin connected to a hole located at a central position of the swing arm and further connected to a slot of the lock cover mount.

6. The mechanism of claim 5, wherein the swing arm has a hole for accommodating a pin which is coupled to a hole of the lock cover mount, such that the pin serves as a pivot for allowing the swing arm to be induced by the link arm and generate the swing motion.

7. The mechanism of claim 5, wherein a hole is formed at the bottom of the swing arm for accommodating a pin used to secure a pulley to the bottom of the swing arm.

8. A fire door lock mechanism comprising a first opening unit located within a fire door and coupled to an opening member mounted on a surface of the fire door for operating a lock bolt of a lock bolt mount that is disposed within the first opening unit to allow the fire door lock mechanism to enter a released or engaged state; and a second opening unit mounted on an opposite surface of the fire door corresponding in position to the opening member, wherein the second opening unit comprises:

a base plate;

a handlebar capable of being pressed to move relative to the base plate;

two actuators rotatably disposed inside the handlebar and bent to form a central portion and two end portions, each of the portions being formed with a hole;

two second horseshoes provided at two bottom ends of the handlebar respectively, each of the second horseshoes being formed with a hole at the bottom end thereof for accommodating a pin inserted into the hole of one end portion of a respective corresponding one of the actuators;

two first horseshoes provided at two ends of the base plate respectively, each of the first horseshoes being formed with a hole at the top end thereof for accommodating a pin inserted into the hole of the central portion of a respective corresponding one of the actuators;

a push rod each end of the push rod being provided with a pin for coupling the hole of the other end portion of a respective corresponding one of the actuators; and a swing arm coupled to an end of the push rod and extended to the inside of the fire door, the swing arm being driven by a motion of the push rod coupled to the handlebar to operate the lock bolt and allow the fire door lock mechanism to enter the corresponding released or engaged state, wherein the actuators, the first horseshoes, the second horseshoes and the push rod are configured such that when the second horseshoes receive a force from the handlebar and move downwardly accordingly, the actuators swing about the first horseshoes as pivots, to thereby induce a horizontal movement of the push rod wherein the first opening unit located inside the fire door further comprises a lock body whose bottom has a slot that horizontally corresponds in position to a protrusion of the lock bolt mount, so as to allow the swing arm to extend into the slot and to be coupled to the protrusion of the lock bolt mount, for making the lock bolt mount move horizontally by a swing motion of the swing arm.

* * * * *